US011518644B2

(12) United States Patent
Fujii

(10) Patent No.: US 11,518,644 B2
(45) Date of Patent: Dec. 6, 2022

(54) TIMING SPECIFYING DEVICE, IMAGE FORMING APPARATUS, MOTOR DRIVE DEVICE, AND TIMING-SIGNAL OUTPUT METHOD

(71) Applicant: Oki Data Corporation, Tokyo (JP)

(72) Inventor: Yosuke Fujii, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 17/200,143

(22) Filed: Mar. 12, 2021

(65) Prior Publication Data

US 2021/0300714 A1 Sep. 30, 2021

(30) Foreign Application Priority Data

Mar. 30, 2020 (JP) ..... JP2020-059864

(51) Int. Cl.
*B65H 43/00* (2006.01)
*G03G 15/00* (2006.01)

(52) U.S. Cl.
CPC ..... *B65H 43/00* (2013.01); *B65H 2403/923* (2013.01); *B65H 2513/50* (2013.01); *G03G 15/5008* (2013.01)

(58) Field of Classification Search
CPC ..... B65H 1/04; B65H 2403/923; B65H 2513/50; B65H 2555/26; B65H 2801/06; B65H 3/0669; B65H 43/00; B65H 7/20; B65H 9/006; G03G 15/5008; G03G 21/14
USPC ..... 358/1.9
See application file for complete search history.

(56) References Cited

U.S. PATENT DOCUMENTS 5,521,696 A * 5/1996 Dunne ..... G01S 17/86 256/28
8,082,462 B1 * 12/2011 Tidwell ..... G06F 1/12 713/400
9,742,416 B2 * 8/2017 Prathapan ..... H03L 7/091
2006/0256907 A1 * 11/2006 Stalker ..... H03K 23/507 375/354
2013/0211758 A1 * 8/2013 Prathapan ..... H03L 7/091 702/66
2018/0097523 A1 * 4/2018 Hoshyar ..... H03L 7/1976
2019/0018338 A1 * 1/2019 Ozeki ..... G03G 15/065
2020/0095077 A1 * 3/2020 Osaki ..... B65H 1/04
2020/0269483 A1 * 8/2020 Byun ..... B29C 49/24
2020/0369483 A1 * 11/2020 Itoh ..... G03G 15/50
(Continued)

FOREIGN PATENT DOCUMENTS

JP H11-341889 A 12/1999

*Primary Examiner* — Negussie Worku
(74) *Attorney, Agent, or Firm* — Rabin & Berdo, P.C.

(57) ABSTRACT

A timing specifying device includes count processing circuitry to count an input reference clock; and timing control circuitry configured to set a parameter having an integer part and a fractional part in the count processing circuitry. The count processing circuitry counts the reference clock, outputs a timing signal indicating that a time corresponding to an integer value has passed, and counts a value corresponding to the fractional part at a timing at which the timing signal is output. The integer value is a value indicated by the integer part. The count processing circuitry stops counting of the reference clock when a value obtained by counting the value corresponding to the fractional part carries over from a fraction.

8 Claims, 8 Drawing Sheets

(56) References Cited

U.S. PATENT DOCUMENTS

| | | | | |
|---|---|---|---|---|
| 2021/0034002 | A1* | 2/2021 | Igo | G03G 15/6529 |
| 2021/0096492 | A1* | 4/2021 | Fujisawa | G03G 15/2053 |
| 2021/0185615 | A1* | 6/2021 | Gulbay | H04W 52/0235 |
| 2021/0255661 | A1* | 8/2021 | Fredenburg | G06F 1/10 |
| 2022/0185615 | A1* | 6/2022 | Takahashi | B65H 11/00 |
| 2022/0234854 | A1* | 7/2022 | Mochizuki | B65H 7/02 |

* cited by examiner

TIMING SPECIFYING DEVICE, IMAGE FORMING APPARATUS, MOTOR DRIVE DEVICE, AND TIMING-SIGNAL OUTPUT METHOD

BACKGROUND OF THE INVENTION

1. Field of the Invention

The present invention relates to a timing specifying device, an image forming apparatus, a motor drive device, and a timing-signal output method.

2. Description of the Related Art

Conventionally, motor control integrated circuits (ICs) have been used for controlling the rotational speed of motors, as described by Ito et al. in Japanese Patent Application Publication No. H11-341889.

In general, when a motor is to be controlled by using a motor control IC, it is necessary to input a motor clock to the motor control IC. Each step of the motor clock is an integer multiple of that of a reference clock. The reference clock number of one step is referred to as a parameter. The rotational speed of the motor varies by the parameter.

SUMMARY OF THE INVENTION

A timing specifying device includes count processing circuitry to count an input reference clock; and timing control circuitry configured to set a parameter having an integer part and a fractional part in the count processing circuitry. The count processing circuitry counts the reference clock, outputs a timing signal indicating that a time corresponding to an integer value has passed, and counts a value corresponding to the fractional part at a timing at which the timing signal is output. The integer value is a value indicated by the integer part. The count processing circuitry stops counting of the reference clock when a value obtained by counting the value corresponding to the fractional part carries over from a fraction.

DETAILED DESCRIPTION OF THE INVENTION

Figure 1:
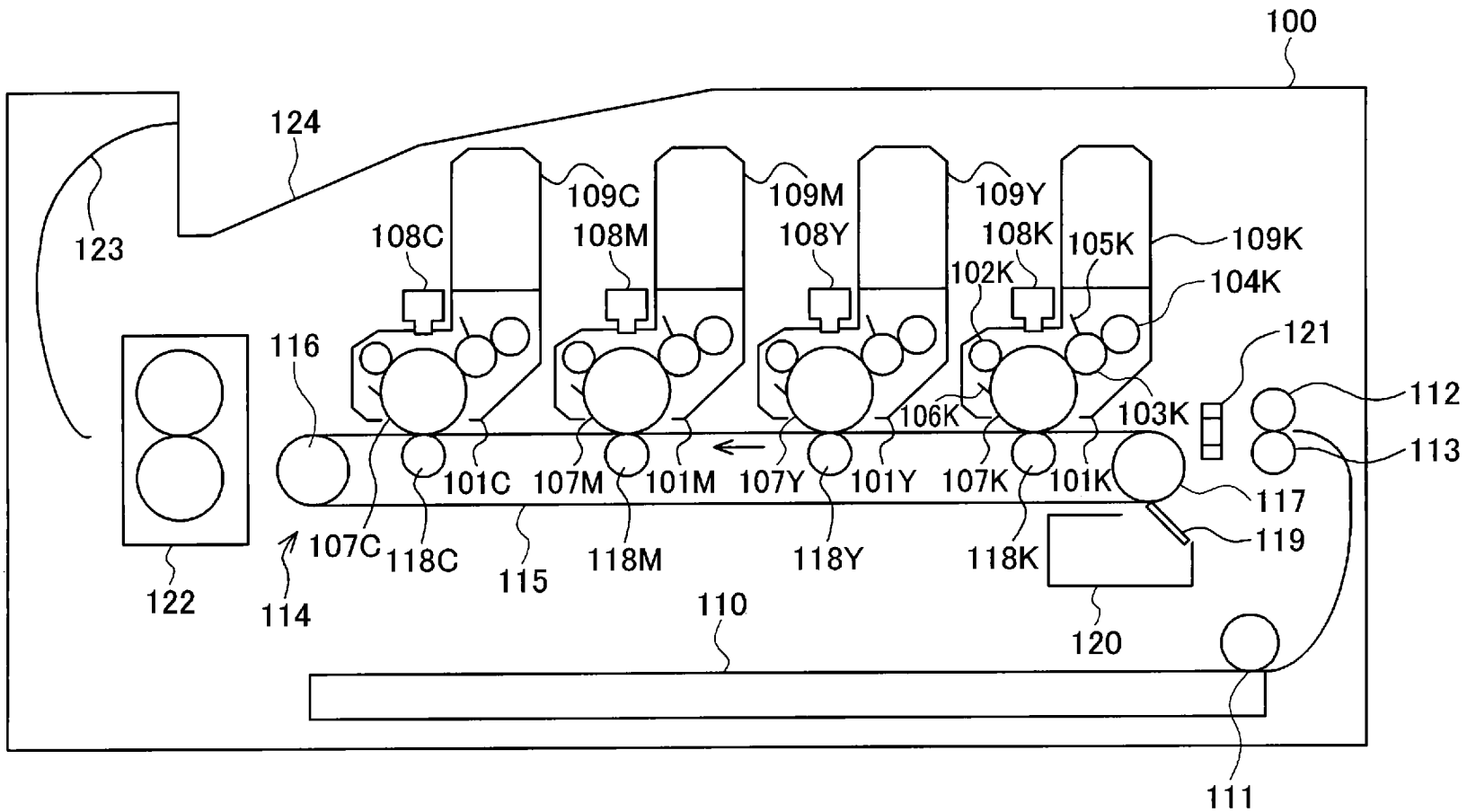
FIG. 1 is a cross-sectional diagram schematically illustrating the configuration of an image forming apparatus.

FIG. 1 is a cross-sectional diagram schematically illustrating the configuration of an image forming apparatus 100 according to an embodiment.

The image forming apparatus 100 is, for example, an image forming apparatus of a color electrophotographic direct transfer system. In this embodiment, the image forming apparatus 100 forms black, magenta, yellow, and cyan images. In the following description, the character "K" is attached to the reference characters denoting elements for forming a black image, the character "M" is attached to the reference characters denoting elements for forming a magenta image, the character "Y" is attached to the reference characters denoting elements for forming a yellow image, and the character "C" is attached to the reference characters denoting elements for forming a cyan image.

Developer cartridges 101K, 101Y, 101M, and 101C form toner images as developer images. Each of the developer cartridges 101K, 101Y, 101M, and 101C is detachable from the image forming apparatus 100. The respective developer cartridges 101K, 101Y, 101M, and 101C have the same configuration except for the color of the toner or developer. Therefore, the developer cartridge 101K will be described below.

The developer cartridge 101K includes a charging roller 102K, a developing roller 103K, a supply roller 104K, a developing blade 105K, a cleaning blade 106K, and a photoreceptor drum 107K.

The charging roller 102K electrically charges the photoreceptor drum 107K.

The developing roller 103K forms a toner image as a developer image by causing toner as developer to adhere to the photoreceptor drum 107K.

The supply roller 104K supplies toner to the developing roller 103K.

The developing blade 105K forms a uniform toner layer as a developer layer on the surface of the developing roller 103K.

The cleaning blade 106K removes unwanted materials, such as toner, remaining on the photoreceptor drum 107K.

The photoreceptor drum 107K is an image carrier.

LED heads 108K, 108Y, 108M, and 108C are exposure units for forming electrostatic latent images on the surfaces of the photoreceptor drums 107K, 107Y, 107M, and 107C, respectively. The LED heads 108K, 108Y, 108M, and 108C are detachable from the developer cartridges 101K, 101Y, 101M, and 101C, respectively.

Toner cartridges 109K, 109Y, 109M, and 109C are developer storage units for supplying color toner corresponding to the developer cartridges 101K, 101Y, 101M, and 101C, respectively.

Sheets that are media on which images are formed are stored in a sheet cassette 110 as a medium storage unit.

A hopping roller 111 removes one sheet from the sheet cassette 110.

The sheet removed by the hopping roller 111 is sent to a transfer unit 114 by paired registration rollers 112 and 113. A sheet detection sensor 121 is provided to detect a sheet in order to control the timing of toner image transfer by the transfer unit 114.

The transfer unit 114 transports one sheet and transfers a toner image from at least one of the developer cartridges 101K, 101Y, 101M, and 101C onto the sheet. The transfer unit 114 includes a transfer belt 115, a drive roller 116, a stretching roller 117, transfer rollers 118K, 118Y, 118M, and 118C, a cleaning blade 119, and a waste toner container 120.

The transfer belt 115 that is stretched over the drive roller 116 and the stretching roller 117 moves in the direction indicated by the arrow in FIG. 1 by the driving force of the drive roller 116, to transport the sheet sent out from the paired registration rollers 112 and 113.

The drive roller 116 provides a driving force for moving the transfer belt 115.

The stretching roller 117 stretches the transfer belt 115 between itself and the drive roller 116.

The transfer rollers 118K, 118Y, 118M, and 118C transfer toner images from the respective developer cartridges 101K, 101Y, 101M, and 101C onto the sheet transported by the transfer belt 115.

The cleaning blade 119 removes unwanted materials, such as toner, adhering to the transfer belt 115.

The waste toner container 120 stores the unwanted material removed by the cleaning blade 119.

The sheet onto which the toner images are transferred by the transfer unit 114 is sent from the transfer unit 114 to a fixing device 122.

The fixing device 122 fixes the toner images onto the sheet with heat and pressure.

The sheet onto which the toner images are fixed by the fixing device 122 travels along a transport guide 123 and is output to a sheet output tray 124.

Figure 2:
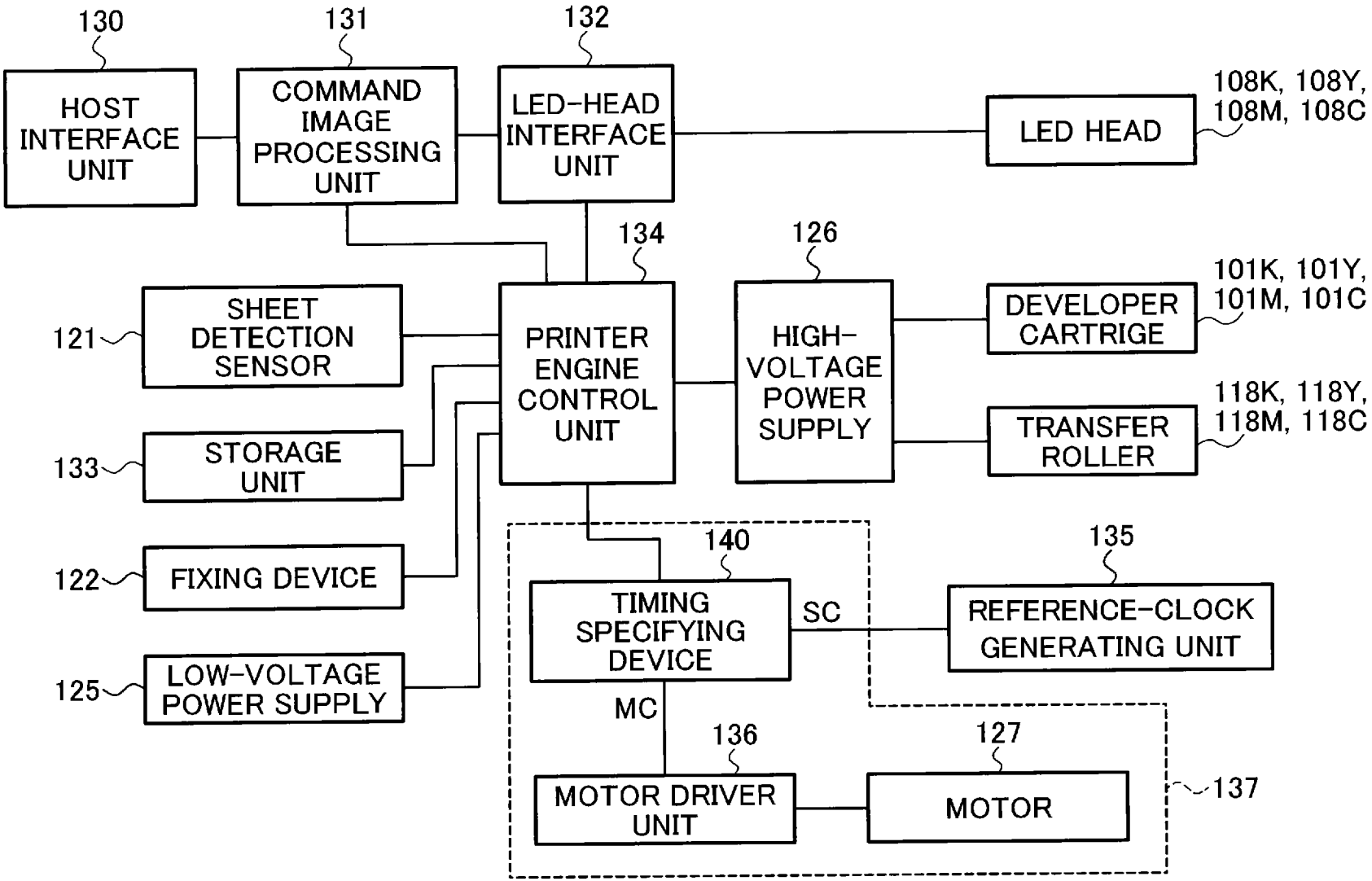
FIG. 2 is a block diagram illustrating a control circuit of the image forming apparatus.

FIG. 2 is a block diagram illustrating a control circuit of the image forming apparatus 100.

The control circuit of the image forming apparatus 100 includes a host interface unit 130, a command image processing unit 131, an LED-head interface unit 132, a storage unit 133, a printer engine control unit 134, a reference-clock generating unit 135, a motor driver unit 136, and a timing specifying device 140 functioning as a timing specifying unit.

Here, the image forming apparatus 100 performs image formation processing using the timing specifying device 140.

The host interface unit 130 receives print data as image formation data from an external device such as a personal computer serving as a host.

The command image processing unit 131 generates an image from the image data included in the print data received by the host interface unit 130.

The LED-head interface unit 132 transmits a signal to at least one of the LED heads 108K, 108Y, 108M, and 108C in accordance with an instruction from the command image processing unit 131 to form an electrostatic latent image on the surface of the corresponding at least one photoreceptor drums 107K, 107Y, 107M, and 107C.

The storage unit 133 stores programs and data necessary for processing by the image forming apparatus 100.

The printer engine control unit 134 uses the programs and data stored in the storage unit 133 to comprehensively control the processing by the image forming apparatus 100.

For example, the printer engine control unit 134 controls the command image processing unit 131 and the LED-head interface unit 132 to cause them to perform processing relating to the images to be formed on a sheet.

The printer engine control unit 134 controls a low-voltage power supply 125 for supplying a relatively low voltage to each component in the control circuit.

Moreover, the printer engine control unit 134 controls a high-voltage power supply 126 for supplying a relatively high voltage to the developer cartridges 101K, 101Y, 101M, and 101C and the transfer rollers 118K, 118Y, 118M, and 118C.

The printer engine control unit 134 controls the timing specifying device 140 to control the rotational speed of a motor 127 via the motor driver unit 136.

The motor 127 is, for example, a hopping motor for driving the hopping roller 111, a registration motor for driving one of the paired registration rollers 112 and 113, a belt motor for driving the transfer belt 115, a fixing device motor for driving the fixing device 122, or a drum motor for driving the photoreceptor drums 107K, 107Y, 107M, and 107C.

The timing specifying device 140 counts a reference clock SC fed from the reference-clock generating unit 135 and outputs a motor clock MC to the motor driver unit 136 in accordance with the counted value so as to achieve the rotational speed instructed by the printer engine control unit 134. The reference clock is a clock serving as a reference of operation and is also referred to as a system clock.

The motor driver unit 136 is a motor driver device that rotates the motor 127 in response to the motor clock MC.

Here, the timing specifying device 140, the motor driver unit 136, and the motor 127 constitute a motor drive device 137.

Print data described in a page description language (PDL) or the like in a predetermined format is input from an external device (not illustrated) to the image forming apparatus 100 illustrated in FIG. 1 via the host interface unit 130 illustrated in FIG. 2. The input print data is converted to a bit map data image by the command image processing unit 131.

The printer engine control unit 134 makes the heat fixing roller of the fixing device 122 to be a predetermined temperature by controlling a fixing device heater in accordance with the detection value of a thermistor, and then starts printing operation.

One sheet is fed from the sheet cassette 110 illustrated in FIG. 1 by the hopping roller 111. The paired registration rollers 112 and 113 send the sheet to the transfer belt 115 at a timing synchronized with the image forming operation explained below.

The developer cartridges 101K, 101Y, 101M, and 101C form toner images on the photoreceptor drums 107K, 107Y, 107M, and 107C, respectively, through an electrophotographic process. At this time, the corresponding LED heads 108K, 108Y, 108M, and 108C are lighted in accordance with the bit map data.

The toner images developed by the developer cartridges 101K, 101Y, 101M, and 101C are transferred onto the sheet transported by the transfer belt 115 by a bias applied when the sheet passes through nips corresponding to the transfer rollers 118K, 118Y, 118M, and 118C.

The sheet onto which the toner images have been transferred is sent to the fixing device 122, and the toner images are fixed to the sheet by the fixing device 122.

The sheet then travels along the transport guide 123 and is output to the sheet output tray 124.

Figure 3:
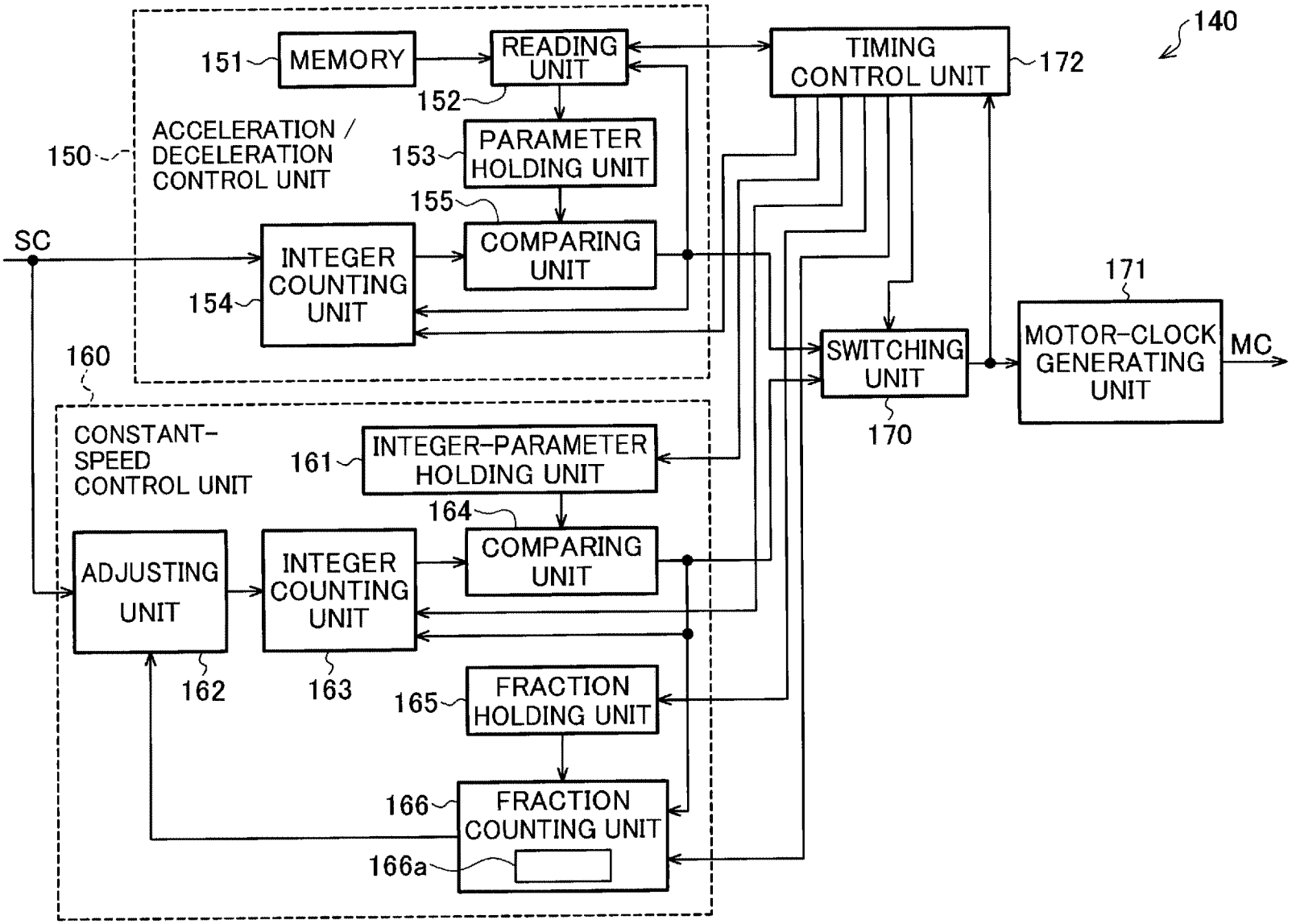
FIG. 3 is a block diagram schematically illustrating the configuration of a timing specifying device.

FIG. 3 is a block diagram schematically illustrating the configuration of the timing specifying device 140.

The timing specifying device 140 includes an acceleration/deceleration control unit 150, a constant-speed control unit 160, a switching unit 170, a motor-clock generating unit 171, and a timing control unit 172.

The acceleration/deceleration control unit 150 includes a memory 151, a reading unit 152, a parameter holding unit 153, an integer counting unit 154, and a comparing unit 155.

The memory 151 stores multiple parameter sets. Each of the parameter sets contains multiple parameters sequentially used when the motor 127 is accelerated or decelerated. Here, the parameter sets stored in the memory 151 are also referred to as speed change parameter sets, and the parameters in each parameter set are referred to as speed change parameters.

In response to an instruction from the timing control unit 172, the reading unit 152 selects, from the multiple parameter sets, one parameter set corresponding to the speed to which the motor 127 is to be accelerated or decelerated. The reading unit 152 then sequentially reads, from the selected parameter set, the parameters for acceleration or deceleration of the motor 127.

Specifically, the reading unit 152 reads the first parameter in the selected parameter set and then repeatedly reads the next parameter when a pulse is fed from the comparing unit 155. The read parameter is fed to the parameter holding unit 153. When the reading unit 152 reads all parameters in the selected parameter set, in other words, when the reading unit 152 reads the last parameter in the parameter set, the reading unit 152 notifies the timing control unit 172.

In this way, the reading unit 152 functions as an output unit for sequentially outputting speed change parameters one at a time from a speed change parameter set containing multiple speed change parameters for acceleration or deceleration of the motor 127.

The parameter holding unit 153 holds the parameters fed from the reading unit 152.

Note that, as described above, a parameter is a reference clock number indicating the timing of driving of the motor 127. For example, in the case where the motor 127 is a stepping motor, the parameter is the reference clock number corresponding to each step.

The integer counting unit 154 counts the reference clock SC fed from the reference-clock generating unit 135 and feeds a counted value, which is a value obtained by counting, to the comparing unit 155.

Specifically, the integer counting unit 154 resets the count value to an initial value (zero, in this case) in response to a count start instruction from the timing control unit 172, and starts counting.

When a pulse is sent from the comparing unit 155, the integer counting unit 154 resets the count value to an initial value and continues counting.

A comparing unit 155 compares the count value counted by the integer counting unit 154 with the parameter held by the parameter holding unit 153 and determines whether or not the values match. If the count value matches the parameter, the comparing unit 155 feeds a clock indicating that the count value has reached the parameter, in other words, that a set time has passed, to the reading unit 152, the integer counting unit 154, and the switching unit 170. Here, the clock output from the comparing unit 155 is also referred to as a speed change timing signal.

As described above, the comparing unit 155 functions as a speed-change count processing unit (speed-change count processing circuitry) that counts the reference clock, outputs a speed change timing signal when the time corresponding to the speed change parameter output from the reading unit 152 passes, and causes the reading unit 152 to output the next speed change parameter from the speed change parameter set.

The constant-speed control unit 160 is a count processing unit (count processing circuitry) that counts the reference clock SC output from the reference-clock generating unit 135.

When the count value obtained by counting the reference clock SC reaches the integer value indicated by the integer part of the parameter set by the timing control unit 172, the constant-speed control unit 160 outputs a pulse that is a timing signal indicating the passing of time set by the parameter. At the timing of outputting the timing signal, the constant-speed control unit 160 counts the value corresponding to the fractional part of the parameter set by the timing control unit 172, and at the timing at which the value obtained by counting the value corresponding to the fractional part in the first decimal place carries to the next digit, the constant-speed control unit 160 resumes the counting of the reference clock SC without counting one cycle of the reference clock SC. The fractional part in this embodiment is a decimal part.

The constant-speed control unit 160 includes an integer-parameter holding unit 161, an adjusting unit 162, an integer counting unit 163, a comparing unit 164, a fraction holding unit 165, and a fraction counting unit 166.

The integer-parameter holding unit 161 holds an integer value that is a value corresponding to the integer part of the parameter. The integer value is fed from the timing control unit 172.

When a pulse is sent from the fraction counting unit 166, the adjusting unit 162 blocks one clock cycle of the reference clock SC fed from the reference-clock generating unit 135, and then feeds the reference clock SC to the integer counting unit 163 again. When no pulse is sent from the fraction counting unit 166, the adjusting unit 162 simply passes the reference clock SC.

In other words, when the fraction counting unit 166 detects the timing at which the value obtained by counting the fractional part carries over from the first decimal place, the adjusting unit 162 blocks the reference clock SC input to the integer counting unit 163 by one count of the reference clock SC.

In an example of blocking (stopping) the counting, when the integer counting unit 163, which is a counting unit (counting circuitry), counts the rising or falling trigger timing edge of the reference clock waveform, the adjusting unit 162 is provided with a latch circuit that is activated when a carry occurs in the fraction counting unit 166. When a trigger timing edge to be counted in the reference clock input to the adjusting unit 162 is input once, the adjusting unit 162 may not change the output, and when the trigger timing edge is input twice, the adjusting unit 162 may resume the passing of the input reference clock. In such a case, the output from the adjusting unit 162 does not change for one cycle of the reference clock.

When the trigger timing edge to be counted in the reference clock is input once, the adjusting unit 162 may not change the output, and when an opposite timing edge not to be counted in the reference clock is input once, the adjusting unit 162 may resume the passing of the input reference clock. In such a case, the output from the adjusting unit 162 does not change for half a cycle of the reference clock.

The integer counting unit 163 is a counting unit that counts the reference clock SC fed from the adjusting unit 162. The integer counting unit 163 feeds the count value, which is obtained by counting, to the comparing unit 164. The count value is used for calculation of the time corresponding to an integral multiple of the reference clock.

Specifically, the integer counting unit 163 resets the count value to an initial value (zero, in this case) in response to a count start instruction from the timing control unit 172, and starts counting.

When a pulse is sent from the comparing unit 164, the integer counting unit 163 resets the count value to an initial value and continues counting.

The comparing unit 164 compares the count value counted by the integer counting unit 163 with the integer value held by the integer-parameter holding unit 161 and determines whether or not the values match. When the count value matches the integer value, the comparing unit 164 feeds a pulse the integer counting unit 163, the fraction counting unit 166, and the switching unit 170. The pulse is a timing signal which indicates that the set time has passed, in other words, that the count value has reached the integer value. Here, the timing signal is also referred to as a speed change timing signal.

The fraction holding unit 165 holds a value corresponding to the fractional part of the parameter. The value corresponding to the fractional part of the parameter is fed from the timing control unit 172.

Specifically, the fraction holding unit 165 holds a number of bits corresponding to the fractional part of the parameter fed from the timing control unit 172 in accordance with the capacity of the memory 166*a* used when the fraction counting unit 166 counts. Here, the number of bits stored in the fraction holding unit 165 corresponds to the product of the capacity of the memory 166*a* and the fraction part of the parameter fed from the timing control unit 172. For example, if the capacity of the memory 166*a* is 256 bits and the fractional part of the parameter fed from the timing control unit 172 is 0.3, the fraction holding unit 165 stores 77 (≈256×0.3) bits. Note that, although the fractional part of the product of the capacity of the memory 166*a* and the fractional part of the parameter fed from the timing control unit 172 is rounded up, the present invention is not limited to such an example. For example, the fractional part may alternatively be rounded off or rounded down.

The fraction counting unit 166 counts the value corresponding to the fractional part of the parameter at the timing at which a pulse is output from the comparing unit 164, and detects the timing at which the value obtained by counting the value corresponding to the fractional part in the first decimal place carries to the next digit. In other words, the fraction counting unit 166 calculates the fractional part that is the fractional time of the reference clock.

Specifically, when a pulse is fed from the comparing unit 164, the fraction counting unit 166 counts the fractional part by storing the number of bits stored in the fraction holding unit 165 in the memory 166*a*. Then, when the count value reaches a predetermined value, the fraction counting unit 166 determines that it is a timing at which the fraction part in the first decimal place carries to the next digit. When the fraction counting unit 166 detects the timing of the carry, the fraction counting unit 166 feeds a pulse indicating that a carry has occurred to the adjusting unit 162.

Note that the fraction counting unit 166 clears the memory 166*a* at the time of the carry and stores the number of bits remaining after the carry in the memory 166*a*.

In response to an instruction from the timing control unit 172, the switching unit 170 switches the output pulse between the pulse output from the acceleration/deceleration control unit 150 and the pulse output from the constant-speed control unit 160.

Note that when the phase of the pulse output from the acceleration/deceleration control unit 150 is different from the phase of the pulse output from the constant-speed control unit 160 at the switching timing, the switching unit 170 switches the pulse after performing inversion processing to the pulse of the switching destination to align the phase with the pulse of the switching source.

As described above, when the speed of the motor 127 reaches a predetermined speed, the switching unit 170 switches the signal output to the motor-clock generating unit 171 from the speed change timing signal from the comparing unit 155 to the timing signal from the comparing unit 164.

The motor-clock generating unit 171 generates a motor clock MC for controlling the rotation of the motor 127 in accordance with the pulse fed from the switching unit 170. For example, the motor-clock generating unit 171 generates a motor clock MC that rises at the rising timing of the pulse fed from the switching unit 170 and sends the motor clock MC to the motor 127, to drive the motor 127 at a speed corresponding to a parameter set by the timing control unit 172.

The timing control unit 172 controls the processing by the timing specifying device 140.

For example, when the timing control unit 172 receives an instruction to start driving of the motor 127 from the printer engine control unit 134, the timing control unit 172 causes the reading unit 152 to sequentially read, from the memory 151, parameters in the parameter set for the acceleration of the motor 127. The timing control unit 172 instructs the integer counting unit 154 to reset the count value of the integer counting unit 154 to an initial value and start counting. Then, the timing control unit 172 instructs the switching unit 170 to output the pulse output from the acceleration/deceleration control unit 150 to the motor-clock generating unit 171.

Then, when the timing control unit 172 detects the pulse output from the switching unit 170 after receiving from the reading unit 152 a notification that the last parameter in the parameter set has been read, the timing control unit 172 stops the counting by the acceleration/deceleration control unit 150, sets a parameter corresponding to the rotational speed of the motor 127 instructed by the printer engine control unit 134 for the constant-speed control unit 160, and causes the constant-speed control unit 160 to start counting.

Specifically, the timing control unit 172 instructs the integer counting unit 154 to stop counting.

The timing control unit 172 specifies the parameter corresponding to the rotational speed of the motor 127 instructed by the printer engine control unit 134. Here, the parameter corresponding to the rotational speed can have an integer part and a fractional part. The parameter specified here is also referred to as an ideal parameter.

Then, the timing control unit 172 causes the integer-parameter holding unit 161 to hold an integer value that is indicated by the integer part of the specified parameter, and causes the fraction holding unit 165 to hold the value corresponding to the fractional part of the specified parameter.

As described above, the timing control unit 172 can set a parameter having an integer part and a fractional part in the constant-speed control unit 160.

For example, when the specified parameter is 2.3, the timing control unit 172 causes the integer-parameter holding unit 161 to hold the integer part "2" and causes the fraction holding unit 165 to hold a value corresponding to the fractional part "0.3."

As described above, a value corresponding to the capacity of the memory 166*a* used by the fraction counting unit 166 for counting is calculated by the timing control unit 172, and the calculated value is held by the fraction holding unit 165.

Then, the timing control unit 172 instructs the integer counting unit 163 and the fraction counting unit 166 to start the counting, and further instructs the switching unit 170 to output the pulse output from the constant-speed control unit 160 to the motor-clock generating unit 171.

Here, the motor drive device 137 illustrated in FIG. 2 includes the timing specifying device 140; the motor driver unit 136 that receives the motor clock MC from the motor-clock generating unit 171 and performs drive control of the motor 127 in accordance with the motor clock MC; and the motor 127 that generates a driving force in accordance with the drive control.

Figure 4:
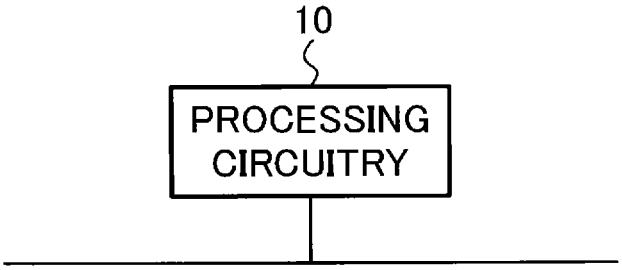
FIG. 4 is a block diagram illustrating a hardware configuration example of the timing specifying device.

The acceleration/deceleration control unit 150, the constant-speed control unit 160, the switching unit 170, the motor-clock generating unit 171, and the timing control unit 172 of the timing specifying device 140 configured as described above can be implemented by processing circuitry 10, such as a single circuit, a composite circuit, a programmed processor, a parallel-programmed processor, an application specific integrated circuit (ASIC) or a field-programmable gate array (FPGA), as illustrated in FIG. 4.

In other words, the acceleration/deceleration control unit 150 can be implemented by acceleration/deceleration control circuitry. The reading unit 152 can be implemented by reading circuitry (output circuitry). The parameter holding unit 153 can be implemented by parameter holding circuitry. The integer counting unit 154 can be implemented by integer counting circuitry. The comparing unit 155 can be implemented by comparing circuitry. The constant-speed control unit 160 can be implemented by constant-speed control circuitry. The integer-parameter holding unit 161 can be implemented by integer-parameter holding circuitry. The adjusting unit 162 can be implemented by adjusting circuitry. The integer counting unit 163 can be implemented by integer counting circuitry. The comparing unit 164 can be implemented by comparing circuitry. The fraction holding unit 165 can be implemented by fraction holding circuitry. The fraction counting unit 166 can be implemented by fraction counting circuitry. The switching unit 170 can be implemented by switching circuitry. The motor-clock generating unit 171 can be implemented by motor-clock generating circuitry. The timing control unit 172 can be implemented by timing control circuitry.

The operation of the timing specifying device 140 will now be explained.

The initialization operation performed at the start of the motor drive will now be explained.

When the timing control unit 172 receives a drive start instruction of the motor 127 from the printer engine control unit 134, the timing control unit 172 sends an initialization instruction to the integer counting unit 154 of the acceleration/deceleration control unit 150, to set the value counted by the integer counting unit 154 to zero.

The timing control unit 172 instructs the reading unit 152 to select a parameter set for acceleration stored in the memory 151. The reading unit 152 reads the first parameter from the selected parameter set and stores the parameter in the parameter holding unit 153.

Moreover, the timing control unit 172 instructs the switching unit 170 to switch its output to the output from the acceleration/deceleration control unit 150.

The acceleration operation of the timing specifying device 140 will now be explained.

First, the reference clock SC from the reference-clock generating unit 135 is input to the integer counting unit 154 of the acceleration/deceleration control unit 150, and the integer counting unit 154 counts up.

The count value of the integer counting unit 154 is output to the comparing unit 155.

The comparing unit 155 compares the count value with the parameter held in the parameter holding unit 153. When the values are equal, the comparing unit 155 sends a pulse to the switching unit 170, the reading unit 152, and the integer counting unit 154.

Upon reception of the pulse, the reading unit 152 reads a new parameter from the memory 151 and feeds the new parameter to the parameter holding unit 153.

Upon reception of the pulse, the integer counting unit 154 initializes the count value.

During the acceleration operation, the switching unit 170 selects a step switching timing from the acceleration/deceleration control unit 150, so that the pulse from the comparing unit 155 is input to the motor-clock generating unit 171. In this way, the motor-clock generating unit 171 outputs the motor clock MC.

The switching operation from the acceleration operation to the constant speed operation in the timing specifying device 140 will now be explained.

To sequentially read parameters from the parameter set during the acceleration operation, the reading unit 152 reads the parameters from a preset address to another preset address of the memory 151. When the address range reaches the final address, the reading unit 152 notifies the timing control unit 172 of the end of acceleration.

Upon reception of such a notification, the timing control unit 172 specifies a parameter in accordance with the rotational speed instructed by the printer engine control unit 134, sets an integer value corresponding to the integer part of the specified parameter in the integer-parameter holding unit 161, and sets a value corresponding to the fractional part in the fraction holding unit 165. Then, at the timing at which the switching unit 170 outputs a pulse, the timing control unit 172 initializes the integer counting unit 163 and causes the integer counting unit 163 to start counting.

The constant speed operation in the timing specifying device 140 will now be explained.

The reference clock SC from the reference-clock generating unit 135 is input to the adjusting unit 162 of the constant-speed control unit 160. The adjusting unit 162 usually passes the reference clock SC and feeds the reference clock SC to the integer counting unit 163.

When the reference clock SC is input to the integer counting unit 163, the integer counting unit 163 counts up. The count value of the integer counting unit 163 is fed to the comparing unit 164.

The comparing unit 164 compares the count value with an integer value corresponding to the integer part of the parameter held in the integer-parameter holding unit 161. Then, when the values are equal, the comparing unit 164 sends a pulse to the switching unit 170, the fraction counting unit 166, and the integer counting unit 163.

Upon reception of the pulse, the integer counting unit 163 initializes the count value.

Upon reception of the pulse, the fraction counting unit 166 adds a number of bits corresponding to the fractional part of the parameter held in the fraction holding unit 165. At this time, if a carry occurs as a result of the addition of the fractional part, the fraction counting unit 166 feeds a pulse to the adjusting unit 162.

Upon reception of the pulse from the fraction counting unit 166, the adjusting unit 162 blocks the passing of only one clock cycle of the reference clock SC fed from the reference-clock generating unit 135.

During the constant speed operation, the switching unit 170 selects a step switching timing from the constant-speed control unit 160, so that the pulse output from the comparing unit 164 is input to the motor-clock generating unit 171. In this way, the motor-clock generating unit 171 outputs the motor clock MC.

The speed change operation during the constant speed operation in the timing specifying device 140 will now be explained.

When the speed is to be changed during the constant speed operation, the timing control unit 172 rewrites the value held in the integer-parameter holding unit 161 and the value held in the fraction holding unit 165. For example, when the parameter is to be set to "2.25," the timing control unit 172 sets "2" in the integer-parameter holding unit 161 and sets the number of bits corresponding to "0.25" in the fraction holding unit 165. Here, since the capacity of the memory 166*a* used for counting by the fraction counting unit 166 is "256," 64 (=256×0.25) bits are set.

The rewritten parameter is reflected after the integer part of the parameter prior to the rewriting has matched the count value and the comparing unit 164 has output a pulse.

The deceleration operation of the timing specifying device 140 is the same as the acceleration operation except for the parameters read from the memory 151.

Figure 5:
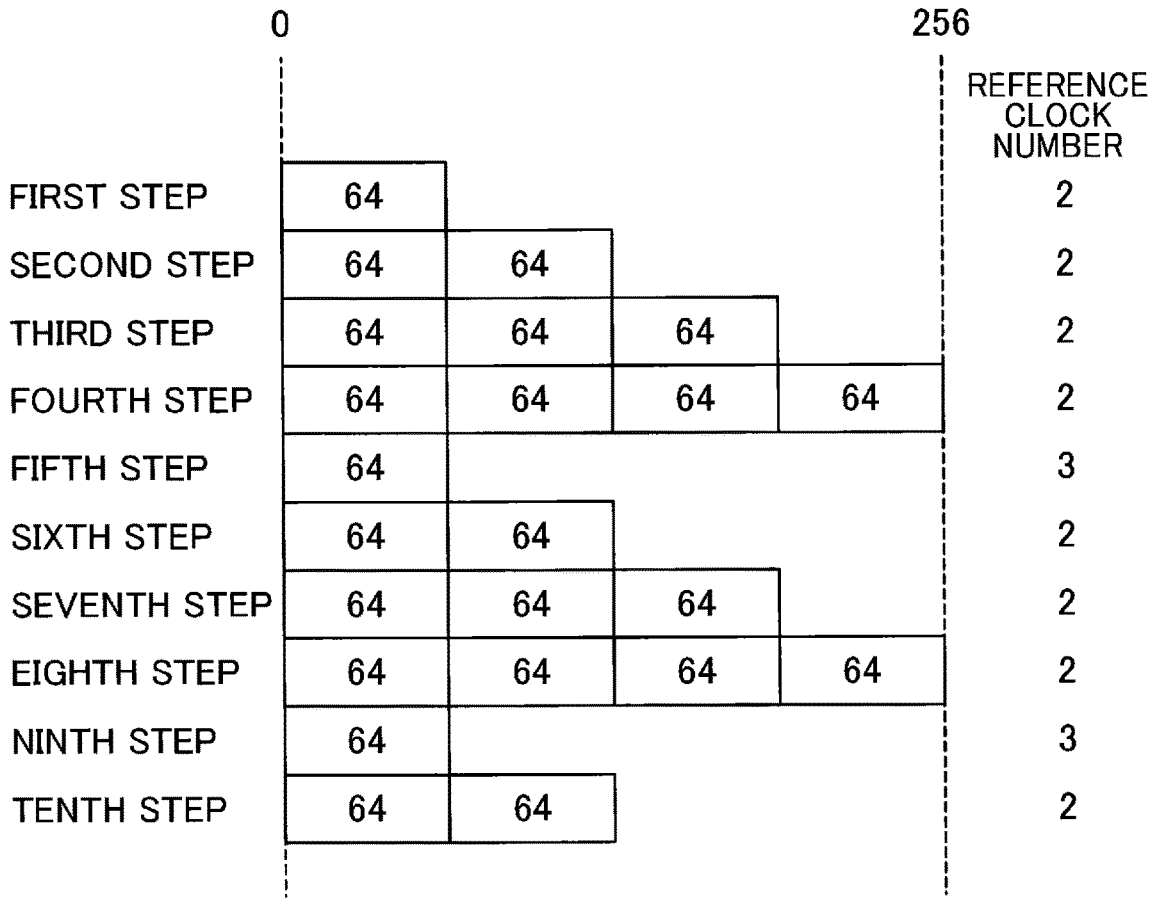
FIG. 5 is a schematic diagram for explaining a first processing example by a fraction counting unit during constant speed operation.

FIG. 5 is a schematic diagram for explaining a first processing example of the fraction counting unit 166 during the constant speed operation.

FIG. 5 illustrates a processing example of a case in which the timing control unit 172 sets "2.25" as a parameter.

The comparing unit 164 outputs a pulse when the integer counting unit 163 counts to two on the basis of the reference clock (first step). Upon reception of the pulse from the comparing unit 164, the fraction counting unit 166 stores, in the memory 166*a*, a number of bits corresponding to the fraction part held in the fraction holding unit 165. Here, 64 bits are added to the value of the memory 166*a*, where "64" is determined by multiplying "256," which is the capacity of the memory 166*a*, by "0.25," which is the fractional part.

When the above processing is repeated up to the fourth step, the sum of the counting reaches 256 bits, which is the capacity of the memory 166*a*, and the value "1" is stored, i.e., a carry occurs; therefore, the fraction counting unit 166 outputs a pulse to the adjusting unit 162 and resets all bits in the memory 166*a* to zero. Here, as a result of the carry, the fractional part becomes zero, and thus, the fraction counting unit 166 restarts counting from zero in the fifth step.

In the fifth step, since the adjusting unit 162 blocks one reference clock cycle, even when the integer counting unit 163 counts to two, the time actually measured is three reference clock cycles.

When the above processing is continued to, for example, the tenth step, 22 reference clock cycles are counted. As a result, the average is 2.2, which is close to the parameter 2.25. The average further approaches the parameter 2.25 if the number of steps is increased.

Figure 6:
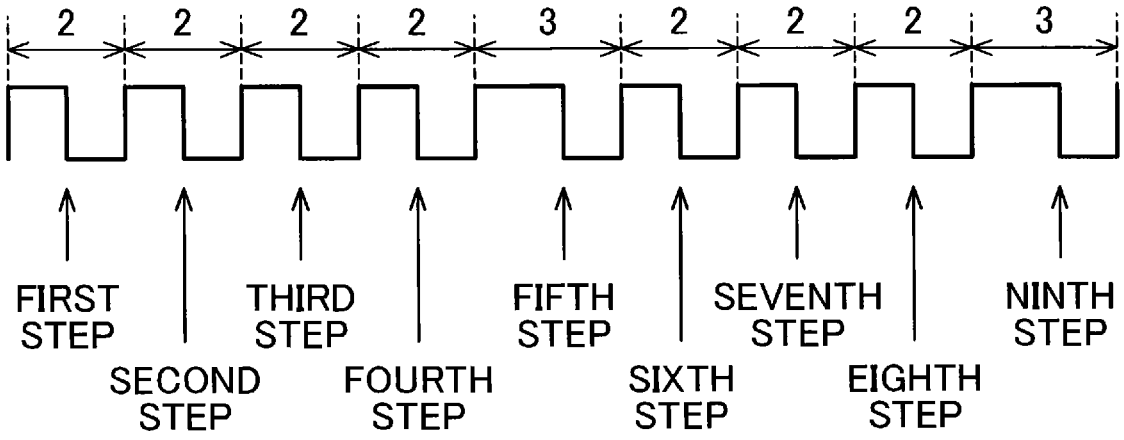
FIG. 6 is a schematic diagram illustrating a first example of a motor clock output by a motor-clock generating unit during constant speed operation.

FIG. 6 is a schematic diagram illustrating a first example of a motor clock output by the motor-clock generating unit 171 during constant speed operation.

FIG. 6 illustrates an example of a motor clock output by the motor-clock generating unit 171 in the case illustrated in FIG. 5.

As illustrated in FIG. 5, in the fifth and ninth steps, the integer counting unit 163 actually counts three reference clock cycles. Therefore, pulses corresponding to three reference clock cycles of the motor clock are output from the motor-clock generating unit 171 in the fifth and ninth steps, as illustrated in FIG. 6.

Figure 7:
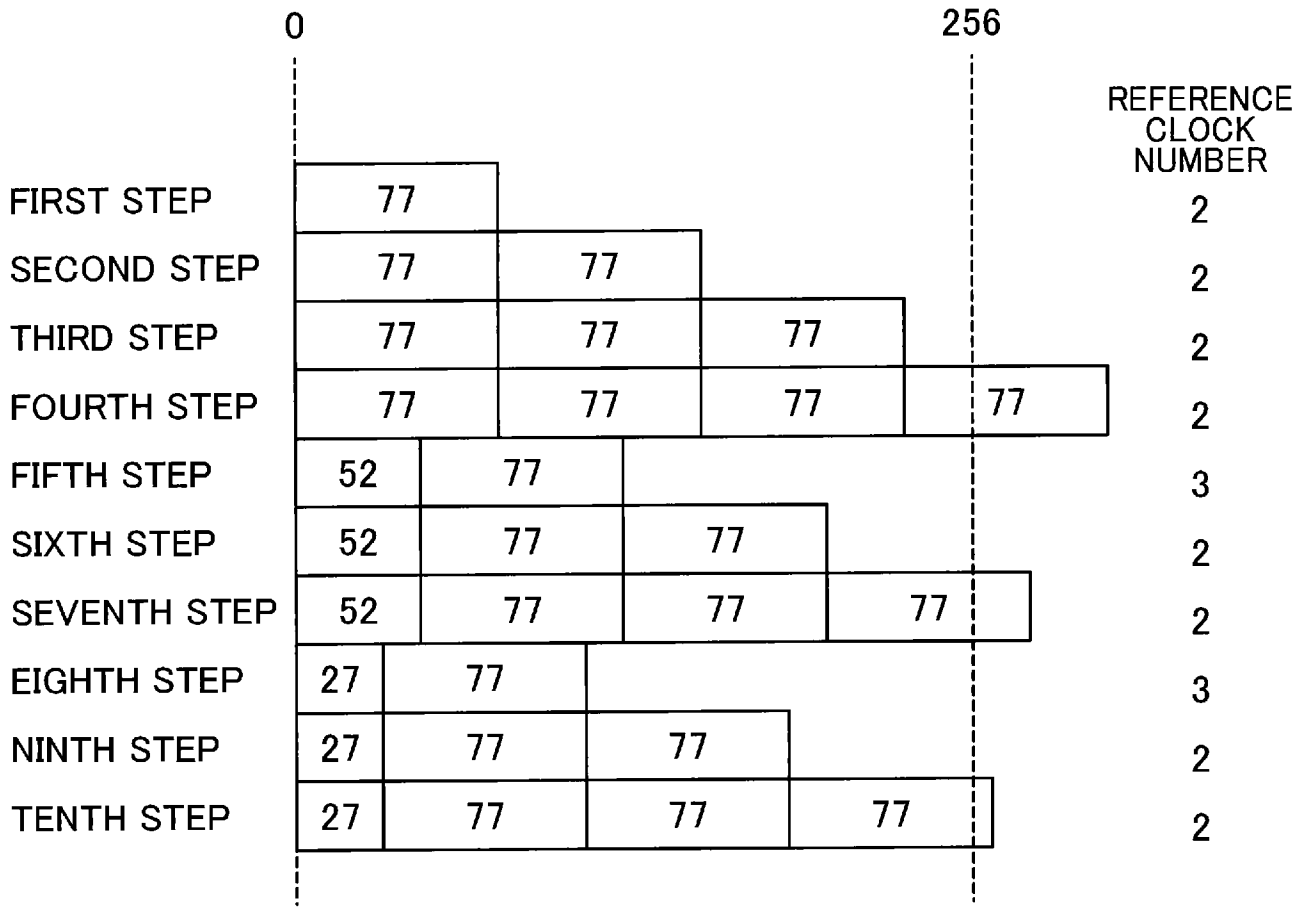
FIG. 7 is a schematic diagram for explaining a second processing example by the fraction counting unit during constant speed operation.

FIG. 7 is a schematic diagram for explaining a second processing example of the fraction counting unit 166 during constant speed operation.

FIG. 7 illustrates a processing example of a case in which the timing control unit 172 sets "2.3" as a parameter.

The comparing unit 164 outputs a pulse when the integer counting unit 163 counts to two on the basis of the reference clock (first step). Upon reception of the pulse from the comparing unit 164, the fraction counting unit 166 stores, in the memory 166*a*, a number of bits corresponding to the fraction part held in the fraction holding unit 165. Here, 77 bits are added to the value of the memory 166*a* and cause a carry, where "77" is determined by multiplying "256," which is the capacity of the memory 166*a*, by "0.3," which is the fractional part.

When the above processing is repeated up to the fourth step, the sum of the counting reaches 256 bits, which is the capacity of the memory 166*a*, and the value "1" is stored, i.e., a carry occurs; therefore, the fraction counting unit 166 outputs a pulse to the adjusting unit 162 and resets all bits in the memory 166*a* to zero. Here, as a result of the carry, 52 bits remain in the fractional part, and as a result, the fraction counting unit 166 restarts counting from the 53rd bit in the fifth step.

In the fifth step, since the adjusting unit 162 blocks one reference clock cycle, even when the integer counting unit 163 counts to two, the time actually measured is three reference clock cycles.

When the above processing is continued to, for example, the tenth step, 22 reference clock cycles are counted. As a result, the average is 2.2, which is close to the parameter 2.3. The average further approaches the parameter 2.3 if the number of steps is increased.

Figure 8:
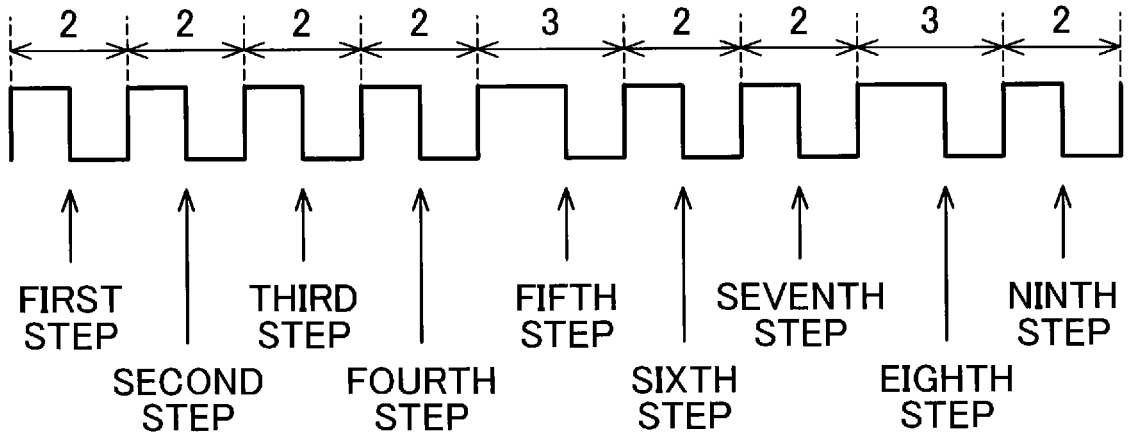
FIG. 8 is a schematic diagram illustrating a second example of a motor clock output by the motor-clock generating unit during constant speed operation.

FIG. 8 is a schematic diagram illustrating a second example of a motor clock output by the motor-clock generating unit 171 during constant speed operation.

FIG. 8 illustrates an example of a motor clock output by the motor-clock generating unit 171 in the case illustrated in FIG. 7.

As illustrated in FIG. 7, in the fifth and eighth steps, the integer counting unit 163 actually counts three reference clock cycles. Therefore, pulses corresponding to three reference clock cycles of the motor clock are output from the motor-clock generating unit 171 in the fifth and eighth steps, as illustrated in FIG. 8.

As described above, according to the present embodiment, it is possible to achieve the same effect as in the case where a parameter having a fractional part is set in the timing specifying device 140.

In the embodiment described above, the timing specifying device 140 generates a motor clock MC for the motor drive unit 136 to control the motor 127, but the embodiment is not limited to such an example.

For example, the timing specifying device 140 may generate an exposure clock for the LED-head interface unit 132 to control the LED heads 108K, 108Y, 108M, and 108C, which are exposure units. In such a case, the timing specifying device 140 may not include the acceleration/deceleration control unit 150 and the switching unit 170, and may include an exposure-clock generating unit (exposure-clock generating circuitry) in place of the motor-clock generating unit 171. The timing control unit 172 sets a parameter corresponding to the exposure timing in the constant-speed control unit 160 in accordance with an instruction from the printer engine control unit 134. The exposure-clock generating unit may feed an exposure clock for controlling the LED heads 108K, 108Y, 108M, and 108C to the LED-head interface unit 132.

In the embodiment described above, a value corresponding to the capacity of the memory 166*a* is held in the fraction holding unit 165, but the embodiment is not limited to such an example. For example, a value corresponding to a predetermined number of bits may be associated with a predetermined decimal number. Specifically, if "1 bit" is associated with the decimal number "0.01," and the fractional part of a parameter is "0.3," the timing control unit 172 causes the fraction holding unit 165 to hold a value corresponding to 30 bits. In this case, when the count value using the memory 166*a* reaches 100 bits, the fraction counting unit 166 may determine that a carry has occurred.

What is claimed is:

1. A timing specifying device comprising:

count processing circuitry to count an input reference clock; and timing control circuitry to set a parameter having an integer part and a fractional part in the count processing circuitry, wherein the count processing circuitry is configured to count one clock cycle of the reference clock as an integer number of one, output a timing signal indicating that a time corresponding to an integer value has passed, output a value corresponding to the fractional part at a timing at which the timing signal is output, the integer value being a value indicated by the integer part, and omit to count one clock cycle of the reference clock when a value obtained by counting the value corresponding to the fractional part carries over from a fraction.

2. The timing specifying device according to claim 1, wherein the count processing circuitry has:

counting circuitry to count the reference clock to calculate a count value;

comparing circuitry to compare the count value with the integer value, and to output the timing signal when the count value reaches the integer value;

fraction counting circuitry to count a value corresponding to the fractional part at a timing at which the timing signal is output, and to detect a timing at which a value obtained by counting the value corresponding to the fractional part reaches a predetermined value as a timing at which the fractional carries over; and adjusting circuitry to block the reference clock for a time corresponding to one cycle of the reference clock input to the counting circuitry at the timing detected by the fraction counting circuitry.

3. The timing specifying device according to claim 1, further comprising:

motor-clock generating circuitry to output a motor clock for controlling rotation of a motor in accordance with the timing signal.

4. The timing specifying device according to claim 3, further comprising:

output circuitry to sequentially output a speed change parameter for acceleration of the motor from a speed change parameter set of the speed change parameters;

speed-change count processing circuitry to output a speed-change timing signal when a time corresponding to the speed change parameter output from the output unit passes by counting the reference clock, and to cause the output circuitry to output the next speed-change parameter from the speed-change parameter set; and switching circuitry to switch a signal to be output to the motor-clock generating circuitry, when the speed of the motor reaches a predetermined speed, from the speed-change timing signal from the speed-change count processing circuitry to the timing signal from the count processing circuitry.

5. A motor drive device comprising:

the timing specifying device according to claim 3;

a motor driver unit configured to receive the motor clock from the motor-clock generating unit, and perform drive control of the motor in accordance with the motor clock; and a motor configured to generate a driving force in response to the drive control.

6. The timing specifying device according to claim 1, further comprising:

exposure-clock generating circuitry to output an exposure clock for controlling an exposure unit in accordance with the timing signal, the exposure unit performing exposure of image forming data.

7. An image forming apparatus comprising: the timing specifying device according to claim 1, the image forming apparatus performing image formation using the timing specifying device.

8. A timing-signal output method comprising:

counting an input reference clock by counting one clock cycle of the reference clock as one value outputting a timing signal indicating that a time corresponding to an integer value has passed, the integer value being a value indicated by an integer part of a set parameter;

counting a value corresponding to a fractional part of the parameter at a timing at which the timing signal is output; and omitting to count one clock of the reference clock when a value obtained by counting the value corresponding to the fractional part carries over from a fraction.

* * * * *